United States Patent [19]

Waugh et al.

[11] Patent Number: 4,829,282

[45] Date of Patent: May 9, 1989

[54] HIGH EFFICIENCY HIGH HEAT OUTPUT ELECTRICAL HEATER ASSEMBLY

[75] Inventors: Arthur Waugh, Winchester, Mass.; Gary A. Orbeck, Windham, N.H.

[73] Assignee: BTU Engineering Corporation, North Billerica, Mass.

[21] Appl. No.: 146,413

[22] Filed: Jan. 21, 1988

[51] Int. Cl.[4] ..... H01C 1/00

[52] U.S. Cl. ..... 338/279; 338/315

[58] Field of Search ..... 338/315–320, 338/279, 280, 281, 282, 283, 288, 290, 292; 219/542, 552, 553

[56] References Cited

U.S. PATENT DOCUMENTS

| | | | |
|---|---|---|---|
| 3,971,912 | 7/1976 | Krüger et al. | 338/318 X |
| 3,984,615 | 10/1976 | Beck | 13/25 |
| 3,984,616 | 10/1976 | Beck | 13/25 |
| 4,011,395 | 5/1977 | Beck | 13/25 |
| 4,091,355 | 5/1978 | Beck | 338/286 |
| 4,161,648 | 7/1979 | Göessler | 338/279 X |

*Primary Examiner*—E. A. Goldberg
*Assistant Examiner*—M. M. Lateef
*Attorney, Agent, or Firm*—Weingarten, Schurgin, Gagnebin & Hayes

[57] ABSTRACT

A high temperature electrical resistance heater in which an electrically resistive strip is supported so that the strip may freely expand and contract and substantially all of the strip may directly radiate to provide maximum heat transport therefrom. The strip is carried in a serpentine configuration by support blocks which are arranged in abutting relation in spaced, parallel rows. Each block includes a lower portion embedded in a ceramic base and an upper portion extending above the base. The upper portion includes a structural portion which encircles minor portions of the strip to carry it spaced above the base to allow substantially unimpeded radiation from the strip and free strip expansion. Anchors securely hold the support blocks embedded within the base.

10 Claims, 4 Drawing Sheets

HIGH EFFICIENCY HIGH HEAT OUTPUT ELECTRICAL HEATER ASSEMBLY

FIELD OF THE INVENTION

This invention relates to high temperature heaters for electrical furnaces, and more particularly to a heater with an electrically resistive strip both anchored to an insulative and thermally stable base and supported on the base so that the strip may freely radiate, expand, and contract.

BACKGROUND OF THE INVENTION

Typically, electrically resistive strips employed in high-temperature electrical furnaces are formed as ribbons or helical coils. The ribbon or coil is supported by a base or support structure. The ribbon or coil may be entirely embedded within the base, or it may be supported in channels and grooves in the base. The conventional heaters having a coil or a ribbon embedded in the base are limited with respect to the speed with which the temperature can be changed. The thermal inertia of the base affects the efficiency of such a conventional heater, insofar as the heat must saturate the base material before direct radiation to the product can occur. In addition, because the coil or ribbon is supported in an open groove, the base material effectively obstructs a substantial portion of the direct radiation emitted by the coil or ribbon, thereby considerably reducing thermal efficiency.

Another prior art high-temperature heater employs a helically wound coil of wire supported continuously along its full length by an anchor of electrically-insulative, high-strength, high-thermal conductivity material embedded in a base support structure. Approximately one third of the coil is hidden in the anchor, and thus it cannot radiate. Further, the part of the coil embedded within the anchor is constrained against thermal expansion and contraction, which leads to coil fatigue. Also, the portion of the coil embedded in the anchor tends to undesirably react with the anchor material.

SUMMARY OF THE INVENTION

The present invention provides a high-temperature heater in which an electrically resistive strip is so supported that substantially all of the strip directly radiates, thereby providing maximum radiative heat transport therefrom. The present invention further provides a high temperature heater in which the electrically resistive strip is so supported that it may freely expand and contract, whereby it is free from fatigue and undesirable chemical reactions, and can carry very high currents. The novel heater includes support blocks arranged in abutting relation in spaced parallel rows through which a heater strip is serpentined. Part of each block is embedded in a base to serve as an anchor, and an extending part of each block includes a structural portion that encircles a minor portion of the strip and supports the strip above the base. The strip, carried spaced above the base with only minor portions thereof encircled, is substantially free providing thereby an unimpeded radiation from the strip. The strip, which rests in the encircling portions of the blocks, is free to thermally expand and contract. Dimensionally stable anchors are disclosed for retaining the embedded part of the rows of blocks in the ceramic block.

The heater of the present invention is particularly suited to heating large, heavy masses rapidly to high temperatures at a comparatively high efficiency.

DETAILED DESCRIPTION OF THE INVENTION

Figure 1:
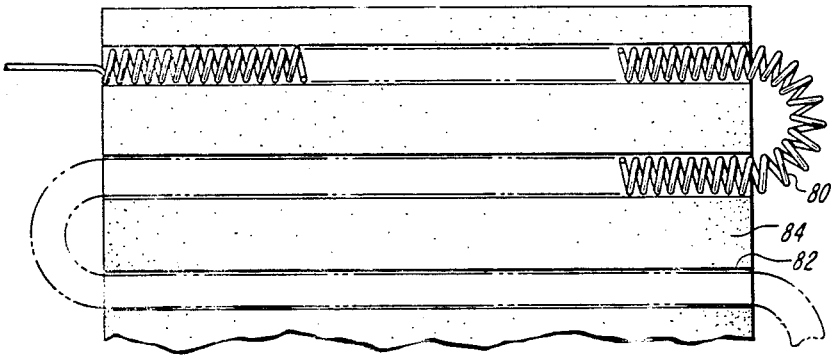
FIG. 1 (PRIOR ART)
FIG. 1 is a plan view of a prior art electrical resistance coil heater.
Figure 2:
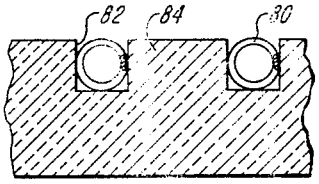
FIG. 2 (PRIOR ART)
FIG. 2 is a partial sectional view of the prior art heater of FIG. 1.
Figure 3:
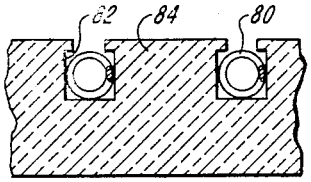
FIG. 3 (PRIOR ART)
FIG. 3 is a partial sectional view of an alternative embodiment of the prior art heater of FIG. 1.

FIGS. 1–3 show a prior art electrical resistance coil heater in which a coil 80 rests in grooves 82 formed in ceramic base 84. Much of the heat from the coil 80 in this heater goes into heating the ceramic base 84. Thus the base 84 effectively obstructs a substantial portion of the direct radiation emitted by the coil 80, considerably reducing thermal efficiency.

Figure 4:
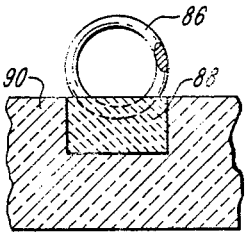
FIG. 4 (PRIOR ART)
FIG. 4 is a partial sectional view of a further prior art electrical resistance coil heater.

FIG. 4 shows a further heater employing a helical coil 86 of wire supported continuously along its full length by an anchor 88 of electrically insulative, high strength, high thermal conductivity material embedded in a ceramic base 90. The portion of the coil 86 embedded in the anchor 88 cannot directly radiate. Further, the embedded portion of the coil is constrained against thermal expansion and contraction, leading to coil fatigue. Also, the embedded portion tends to react undesirably with the anchor material.

Figure 5:
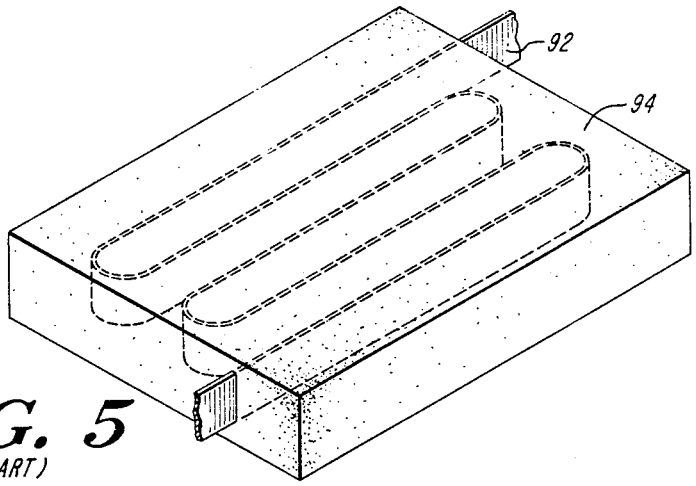
FIG. 5 (PRIOR ART)
FIG. 5 is a perspective view of a prior art electrical resistance ribbon heater.

The prior art heater shown in FIG. 5 has an electrically resistive ribbon 92 completely embedded within a base 94. The heat from the ribbon 92 must saturate the surrounding base material before direct radiation to the product can occur. The base 94 however limits the speed with which the temperature of the heater can be changed and the efficiency with which the product can be heated.

Figure 6:
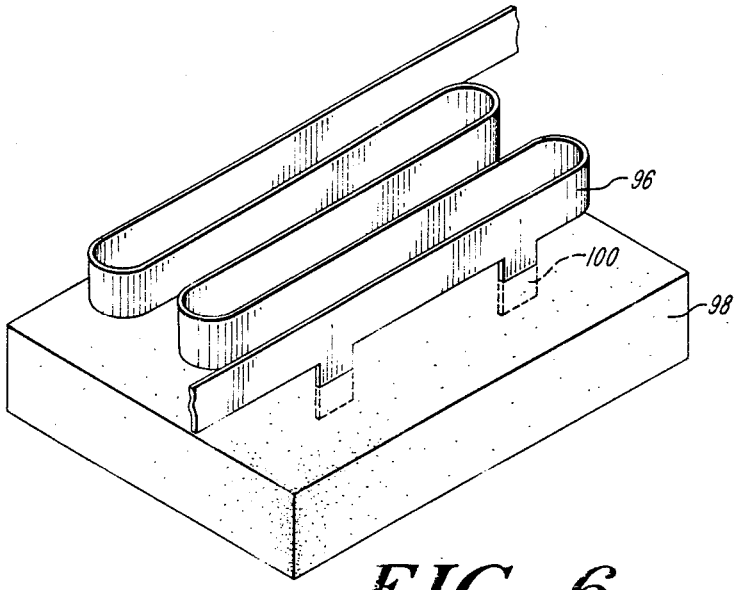
FIG. 6 (PRIOR ART)
FIG. 6 is a perspective view of a further prior art electrical resistance ribbon heater.

FIG. 6 shows another prior art heater with a strip or ribbon 96 spaced above and anchored to base 98 by legs 100 integrally formed on the strip 96. The legs 100 are embedded into the base 9B. The ribbon 96 is thus constrained against free thermal expansion and contraction leading to ribbon distortion and fatigue. Also, the legs 100 are subject to undesirable reaction with the material of the base.

Figure 7:
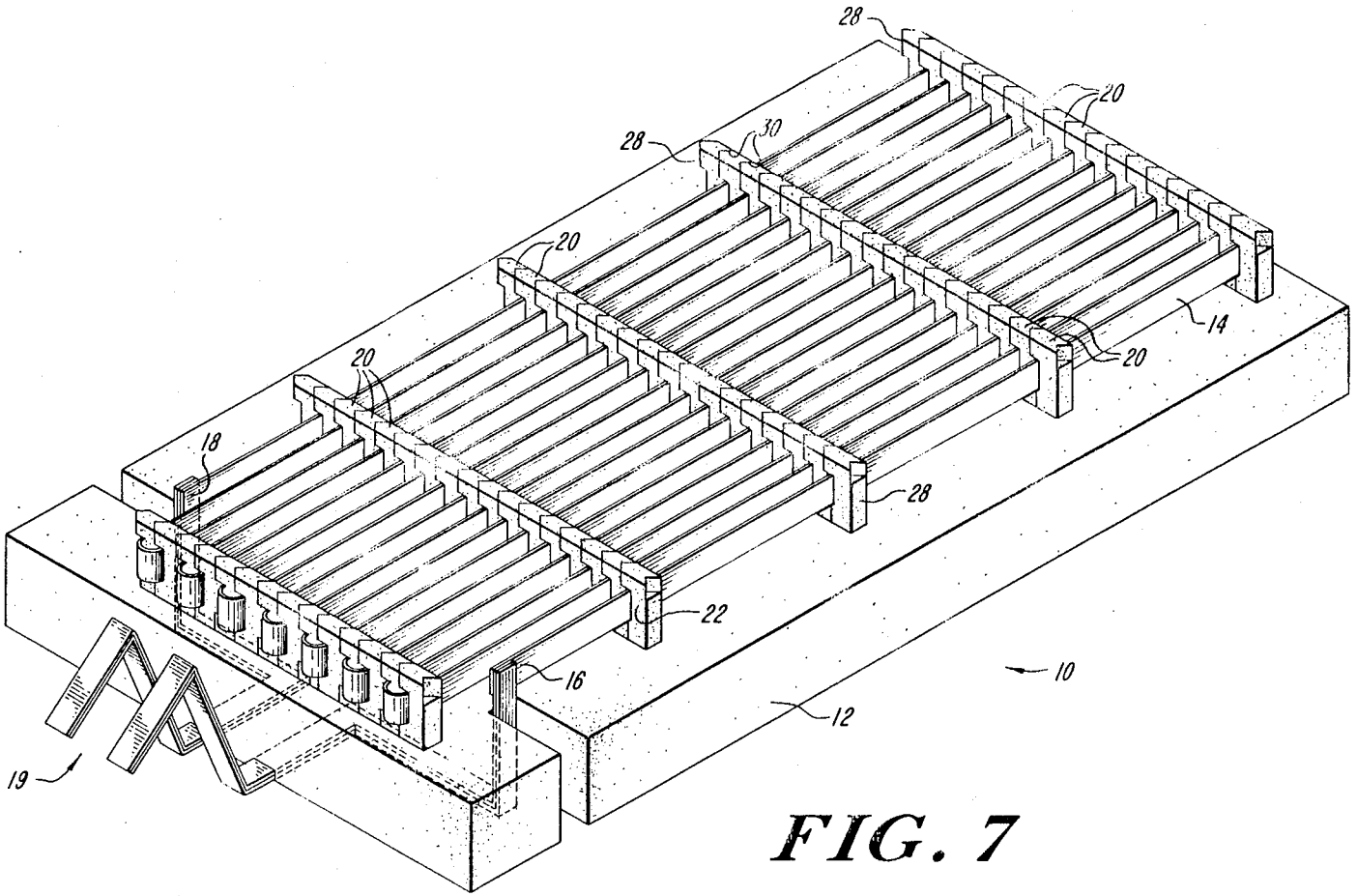
FIG. 7 is a perspective view of an electrical resistance heater according to the present invention.

The high-temperature electrical resistance heater 10 of the present invention is shown in FIG. 7. The heater is formed with a base 12 typically made from a refractory fibrous ceramic material of low thermal inertia.

Alumina or aluminum silicate fibers disposed within an alumina, silica or other high-temperature ceramic bonding material are commonly used.

An electrically resistive strip 14 is disposed in a predetermined configuration on the base 12. A multiple loop serpentine configuration is shown in FIG. 7, but other configurations are also contemplated. For example, the strip could be formed in a spiral or in concentric circles. The strip is shown formed as a ribbon, but alternatively it could be formed from a rod having a circular or other suitable cross-section or as a coil. A first end 16 and a second end 18 of the strip 14 are connected to terminal means 19 to connect the strip 14 to a power source (not shown).

The strip 14 is supported on base 12 by support blocks 20 formed from a ceramic material. The support blocks 20 include an upper portion 22 for supporting the strip 14 in a position spaced above the base 12. As shown in FIGS. 8–11, the upper portion 22 has structural portions 24 which encircle and support the strip 14. The blocks 20 also include lower portions 26 which are embedded within base 12 to hold the blocks firmly anchored in the base 12. In the preferred embodiment the blocks 20 are arranged in spaced, parallel rows 28 so that the structural portions 24 of adjacent blocks align and cooperate to support the strip 14. Aligning means 30 on each block 20 cooperate with aligning means 30 on adjacent blocks to align and hold the blocks 20 together in the rows 28.

The structural portions 24 encircle only minor portions of the entire length of the strip 14, so that, unlike the prior art heaters shown in FIGS. 1–5, substantially all of the strip 14 provides free and unimpeded radiation, as best seen in FIG. 7, thereby achieving a high efficiency. Also, the strip 14 is unrestrictedly supported in the structural portions 24 so that, unlike the prior art heaters shown in FIGS. 4–6, it may freely expand and contract with changes in temperature without mechanical fatigue, without chemical degradation and is capable of a large current handling capacity.

Figure 8:
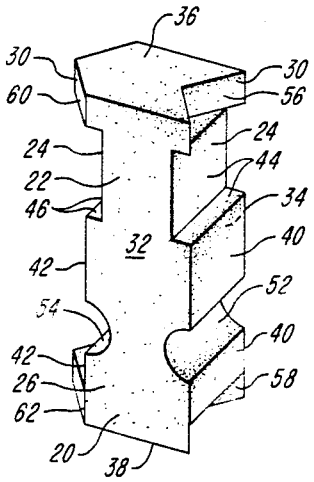
FIG. 8 is a perspective view of a support block according to the present invention.
Figure 9:
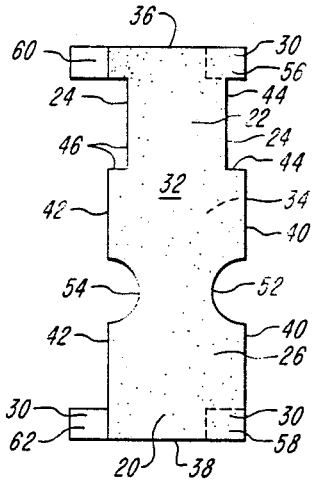
FIG. 9 is a front elevational view of the support block of FIG. 8.

FIGS. 8 and 9 show a preferred embodiment of a single support block 20 in more detail. Each block 20 has a front face 32 and a back face 34, a top face 36, a bottom face 38, a first side 40, and a second side 42. The structural portion 24 of the support means generally comprises first walls 44 recessed into the first side 40 and second walls 46 recessed into the second side 42. Alternatively, the structural portion 24 could comprise a single first wall recessed into the first side 40 and a single second wall recessed into the second side 42, as for example if each wall 44 and 46 were semicircular or arcuate in cross-section. A further embodiment of structural portion 24 could comprise a wall or walls recessed into the first side, but having no walls recessed into the second side. Other embodiments are also contemplated.

A preferred embodiment of the aligning means 30 of each block 20 comprises an upper notch 56 and a lower notch 58 in the first side 40. On the second side 42, the aligning means comprises an upper complementary projection 60 and a lower complementary projection 62. The notches and complementary projections can be formed in any suitable configuration, such as the triangular configuration shown in FIG. 8.

Figure 10:
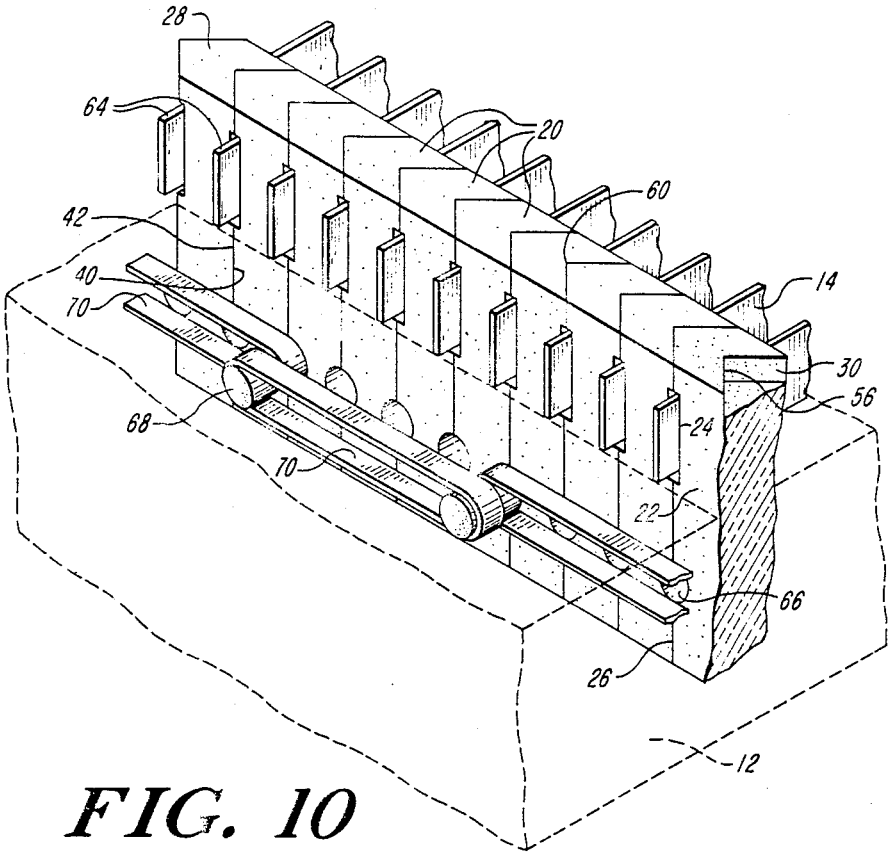
FIG. 10 is a partial perspective view of a row of the support blocks and anchors according to the present invention.
Figure 11:
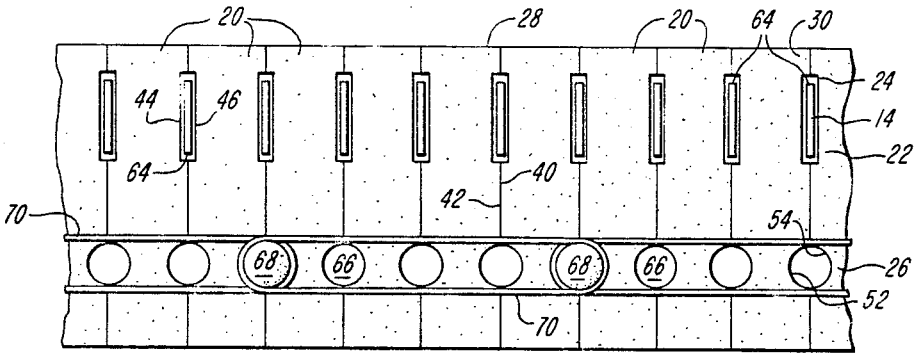
FIG. 11 is a partial front elevational view of the support blocks of FIG. 10.

When the blocks 20 are arranged in rows 28, as shown in FIGS. 10 and 11, the first side 40 of one block 20 abuts the second side 42 of an adjacent block 20. The upper complementary projection 60 is received in upper notch 56 of an adjacent block 20. Similarly, lower complementary projection 62 is received in lower notch 58 of an adjacent block 20. In this way, the blocks 20 are aligned and held in the rows 28. The blocks 20 shown in FIGS. 7 and 10 have first and second sides 40 and 42 at right angles to front face 32 and back face 34, so that the blocks 20 form a straight row 28 when abutting. Alternatively, the sides 40 and 42 could be formed at different angles to the front face 32 and back face 34, so that the blocks could align into curved rows.

Also, when the blocks 20 are arranged in rows 28, first walls 44 of one block 20 align with second walls 46 of an adjacent block 20 forming a support passage 64 through which the strip 14 is disposed so that the strip 14 is encircled and supported by walls 44 and 46. The walls 44 and 46 are dimensioned sufficiently large so that the strip 14 is not constrained within the support passage 64 against movement due to thermal expansion and contraction. The walls 44 and 46 are shown configured to receive strip 14 formed as a ribbon with a narrow rectangular cross-section. However, the walls 44 and 46 can be appropriately configured to support a strip 14 of any desired cross-section, such as circular or elliptical, or to support an electrically resistive coil.

The lower portion 26 of each block 20 includes a first anchor recess 52 in the first side 40 and a second anchor recess 54 in the second side 42. When the blocks 20 are arranged in rows 28, first anchor recess 52 of one block 20 aligns with second anchor recess 54 of an adjacent block 20, forming an anchor passage 66. When the blocks 20 are embedded in base 12, the ceramic material of the base 12 fills the anchor passages 66 to help to ensure that the blocks 20 are anchored to the base 12.

The heater of the present invention also includes anchors to securely tie the support blocks 20 to the base 12. As shown in FIGS. 10 and 11, the anchors preferably comprise dowels 68 disposed through some or all of the anchor passages 66. The dowels 68 project beyond the front face 32 of blocks 20 to extend into the composite ceramic material of the base 12. The dowels 68 may also project beyond the back face 34 of blocks 20 into the base material. The dowels 68 present a considerable drag against pull-out of the blocks 20, and thereby ensure that the blocks 20 are firmly anchored to the base 12. The anchors and anchor passages provide a thermally stable mechanical tie that holds the blocks 20 in intended orientation to within a selected tolerance.

The high-temperature heater is assembled by forming the electrically resistive strip 14 into the desired configuration, such as the serpentine configuration shown in FIG. 7. The support blocks 20 are assembled in abutting relation in rows so that the structural portions 24 encircle the strip 14 and support it in the desired configuration. The blocks 20 may be held together temporarily with tape or other means if desired. The dowels 68 are inserted through the anchor passages 66. Bands 70 may be wrapped around dowels 68 to hold them in place during assembly and aid in tying the blocks 20 to the base 12. The blocks 20 with dowels 68 and strip 14 are placed in a mold. The base 12 is formed in the mold around the lower portion 26 of the blocks 20 from a slurry of water, fibers and a binder by a vacuum forming process well known to those skilled in the art.

The heater of this invention is well suited for heating heavy large masses rapidly. It can operate up to at least 1200° C. and has a power output of at least 10 KW depending upon size of base. The base 12, dowel anchors 68, and support blocks 20 are formed from thermally stable composite ceramic materials that can withstand high temperatures and rapid temperature changes with minimal dimensional changes. Heater panels embodying the invention are mechanically stable, and can be mounted to provide any desirable heating chamber geometry.

Many modifications of the presently disclosed invention will become apparent to those skilled in the art without departing from the inventive concept.

What is claimed is:

1. An electrical resistance heater comprising:

an electrically resistive element disposed in a predetermined pattern;

an electrically insulative and thermally stable base;

terminal means for connecting said electrically resistive element to a power source;

means for supporting said electrically resistive element in said predetermined path spaced above said base so that said electrically resistive element may freely radiate, said means including plural support blocks disposed in abutting relation, each support block including aligning means for aligning said support blocks in abutting relation, a lower portion embedded in said base, and an upper portion extending from said base for supporting said electrically resistive element spaced above said base in said predetermined pattern, said upper portion having structural portions which at least partially encircle minor portions of said electrically resistive element to provide substantially free and unimpeded radiation therefrom and to allow said electrically resistive element to move freely in contraction and expansion; and anchors cooperative with at least some of said lower portions for anchoring said electrically resistive element to said base.

2. The electrical resistance heater of claim 1 wherein:

each of said support blocks has a first side and a second side;

said structural portion of each of said support blocks comprises a wall recessed in said first side and a wall recessed in said second side, said wall recessed in said first side and said wall recessed in said second side being positioned so that when said support blocks are disposed in abutting relation said wall recessed in said first side of one of said blocks aligns with said wall recessed in said second side of an abutting support block to form an element support passage; and said electrically resistive element is disposed through said element support passages so that said minor portions of said electrically resistive element are encircled and supported by said walls.

3. The electrical resistance heater of claim 2 wherein:

said support blocks are disposed in abutting relation in parallel rows spaced apart so that said electrically resistive element is unsupported between said parallel rows.

4. The electrical resistance heater of claim 2 wherein:

each of said support blocks comprises a first anchor recess in said first side and a second anchor recess in said second side, said first anchor recess and said second anchor recess being positioned so that when said support blocks are disposed in abutting relation said first anchor recess of one of said support blocks aligns with said second anchor recess of an abutting support block to form an anchor passage.

5. The electrical resistance heater of claim 4 wherein:

said anchors comprise dowels disposed through said anchor passages and projecting from said anchor passages into said base.

6. The electrical resistance heater of claim 5 further including bands wrapped around some of said dowels.

7. The electrical resistance heater of claim 1 wherein;

each of said support blocks has a first side and a second side;

each of said support blocks comprises a first anchor recess in said first side and a second anchor recess in said second side, said first anchor recess and said second anchor recess being positioned so that when said support blocks are disposed in abutting relation said first anchor recess of one of said support blocks aligns with said second anchor recess of an abutting support block to form an anchor passage.

8. The electrical resistance heater of claim 1 wherein:

each of said support blocks has a first side and a second side;

said aligning means of each of said support blocks includes a notch in said first side and a complementary projection on said second side, said notch and said complementary projection positioned so that when said support blocks are disposed in abutting relation said complementary projection of one of said support blocks is received in said notch of an abutting support block.

9. The electrical resistance heater of claim 1 wherein:

said support blocks are formed from a high strength ceramic material.

10. The electrical resistance heater of claim 1 wherein:

said base is formed of a fibrous ceramic material of low thermal inertia.

* * * * *

UNITED STATES PATENT AND TRADEMARK OFFICE

CERTIFICATE OF CORRECTION

PATENT NO. : 4,829,282

DATED : May 9, 1989

INVENTOR(S) : Arthur Waugh et al.

It is certified that error appears in the above-identified patent and that said Letters Patent is hereby corrected as shown below:

Column 2, line 60, "base 9B." should read --base 98--.

Signed and Sealed this

Eighth Day of October, 1991

*Attest:*

HARRY F. MANBECK, JR.

*Attesting Officer*

*Commissioner of Patents and Trademarks*